US008689796B2

(12) United States Patent
Polk, III

(10) Patent No.: US 8,689,796 B2
(45) Date of Patent: Apr. 8, 2014

(54) MOUTHGUARD WITH LINEAR STORAGE CONFIGURATION

(75) Inventor: Louis F. Polk, III, Excelsior, MN (US)

(73) Assignee: Shock Doctor, Inc., Minnetonka, MN (US)

( * ) Notice: Subject to any disclaimer, the term of this patent is extended or adjusted under 35 U.S.C. 154(b) by 86 days.

(21) Appl. No.: 13/109,678

(22) Filed: May 17, 2011

(65) Prior Publication Data

US 2012/0085354 A1 Apr. 12, 2012

Related U.S. Application Data

(60) Provisional application No. 61/345,331, filed on May 17, 2010.

(51) Int. Cl.
*A61C 5/14* (2006.01)

(52) U.S. Cl.
USPC ..... 128/861

(58) Field of Classification Search
USPC ..... 128/859, 861, 848; 602/902; 206/83, 206/63.5, 368–369; 220/4.22; D24/156; D3/201, 205; 433/6
See application file for complete search history.

(56) References Cited

U.S. PATENT DOCUMENTS

| | | | | |
|---|---|---|---|---|
| 257,038 | A | | 4/1882 | McMann |
| 1,117,928 | A | | 11/1914 | Thurmond |
| 1,146,264 | A | | 7/1915 | Kelly |
| 1,323,832 | A | | 12/1919 | Chige |
| 1,461,209 | A | | 7/1923 | Bridges |
| 1,470,888 | A | | 10/1923 | Smedley |
| 1,487,392 | A | | 3/1924 | Lee |
| 2,118,980 | A | | 5/1938 | Montgomery et al. |
| 2,257,709 | A | | 9/1941 | Anderson |
| 2,444,294 | A | * | 6/1948 | Jones ..... 206/83 |
| 2,521,039 | A | | 9/1950 | Carpenter |
| 2,659,366 | A | | 2/1952 | Savarese |

(Continued)

FOREIGN PATENT DOCUMENTS

| | | |
|---|---|---|
| AU | 1990/62951 | 4/1991 |
| AU | 1992/29170 | 3/1997 |

(Continued)

OTHER PUBLICATIONS

International Search Report issued in PCT/US94/05305, mailed Oct. 4, 1994, 2 pages.

(Continued)

*Primary Examiner* — Tatyana Zalukaeva
*Assistant Examiner* — Camtu Nguyen
(74) *Attorney, Agent, or Firm* — Faegre Baker Daniels LLP

(57) ABSTRACT

A mouthguard has an initial, substantially linear configuration and may be worn in a variety of applications including to protect a person's teeth when the person is engaged in a sports activity such as football, lacrosse, and other contact sports, as well as for concussion protection, user performance enhancement and so forth. The mouthguard includes a first end trough region generally shaped to cooperatively enclose one or more teeth on a first side of a mouth, a second end trough region generally shaped to cooperatively enclose one or more teeth on a second side of the mouth and a connection region spanning between the first end trough region and the second trough region. The connection may include a shaping element for reversibly forming a second, generally non-linear configuration.

4 Claims, 12 Drawing Sheets

(56) References Cited

U.S. PATENT DOCUMENTS 2,630,117 A 3/1953 Coleman
2,643,652 A 6/1953 Cathcart
2,669,988 A 2/1954 Carpenter
2,678,043 A 5/1954 Stark
2,694,397 A 11/1954 Herms
2,702,032 A 2/1955 Freedland
2,708,931 A 5/1955 Freedland
2,750,941 A 6/1956 Cathcart
2,827,899 A 3/1958 Altieri
2,847,003 A 8/1958 Helmer et al.
2,933,811 A 4/1960 Lifton
2,966,908 A 1/1961 Cathcart et al.
3,016,052 A 1/1962 Zubren
3,058,462 A 10/1962 Greenblum
3,073,300 A 1/1963 Berghash
3,082,765 A 3/1963 Helmer
3,089,487 A 5/1963 Enicks et al.
3,103,217 A 9/1963 Butler et al.
3,107,667 A 10/1963 Moore
3,124,129 A 3/1964 Grossberg
3,126,002 A 3/1964 Owens
D198,359 S 6/1964 McLeod
3,203,417 A 8/1965 Helmer
3,207,153 A 9/1965 Goldstein
3,223,085 A 12/1965 Gores et al.
3,247,844 A 4/1966 Berghash
3,312,218 A 4/1967 Jacobs
3,319,626 A 5/1967 Lindsay
3,333,582 A 8/1967 Cathcart
3,407,809 A 10/1968 Ross
3,411,501 A 11/1968 Greenberg
D212,848 S 12/1968 Westlund et al.
3,416,527 A 12/1968 Hoef
3,448,738 A 6/1969 Berghash
3,457,916 A 7/1969 Wolicki
D215,685 S 10/1969 Helmer
3,485,242 A 12/1969 Greenberg
3,496,936 A 2/1970 Gores
3,505,995 A 4/1970 Greenberg
3,513,838 A 5/1970 Foderick et al.
3,518,988 A 7/1970 Gores
3,532,091 A 10/1970 Lerman
3,682,164 A 8/1972 Miller
3,692,025 A 9/1972 Greenberg
3,768,465 A 10/1973 Helmer
3,864,832 A 2/1975 Carlson
3,916,527 A 11/1975 Linkow
RE28,667 E * 12/1975 Gores ..... 128/861
3,924,638 A 12/1975 Mann
3,943,924 A 3/1976 Kallestad et al.
D243,127 S 1/1977 Farquharson
4,030,493 A 6/1977 Walters et al.
4,044,762 A 8/1977 Jacobs
4,063,552 A 12/1977 Going et al.
4,114,614 A 9/1978 Kesling
4,185,817 A 1/1980 Peterson
4,211,008 A 7/1980 Lerman
4,330,272 A 5/1982 Bergersen
4,337,765 A 7/1982 Zimmerman
4,346,205 A 8/1982 Hiles
4,348,178 A 9/1982 Kurz
4,376,628 A * 3/1983 Aardse ..... 433/80
4,457,708 A 7/1984 Dufour
4,519,386 A 5/1985 Sullivan
4,568,280 A 2/1986 Ahlin
4,591,341 A 5/1986 Andrews
4,671,766 A 6/1987 Norton
4,672,959 A 6/1987 May et al.
4,673,791 A 6/1987 Konno et al.
4,727,867 A 3/1988 Knoderer
4,763,791 A 8/1988 Halverson et al.
4,765,324 A 8/1988 Lake, Jr.
4,791,941 A 12/1988 Schaefer
4,793,803 A 12/1988 Martz
4,799,500 A 1/1989 Newbury
4,810,192 A 3/1989 Williams
4,827,578 A 5/1989 Heckerman
4,848,365 A 7/1989 Guarlotti et al.
4,867,147 A 9/1989 Davis
4,889,533 A 12/1989 Beecher
4,924,557 A 5/1990 Heckerman et al.
4,944,947 A 7/1990 Newman
4,955,393 A 9/1990 Adell
4,977,905 A 12/1990 Kittelsen et al.
5,003,994 A 4/1991 Cook
5,031,611 A 7/1991 Moles
5,031,638 A 7/1991 Castaldi
5,063,940 A * 11/1991 Adell et al. ..... 128/861
5,076,785 A 12/1991 Tsai
5,082,007 A 1/1992 Adell
5,112,225 A 5/1992 Diesso
5,117,816 A 6/1992 Shapiro et al.
D328,494 S 8/1992 Schwendeman
5,152,301 A 10/1992 Kittelsen et al.
5,154,609 A 10/1992 George
5,165,424 A 11/1992 Silverman
5,194,004 A 3/1993 Bergersen
5,234,005 A 8/1993 Kittelsen et al.
5,235,991 A 8/1993 Minneman
5,259,762 A 11/1993 Farrell et al.
5,277,203 A 1/1994 Hays
D343,928 S 2/1994 Kittelsen et al.
5,293,880 A 3/1994 Levitt
5,299,936 A 4/1994 Ueno
5,313,960 A 5/1994 Tomasi
5,316,474 A 5/1994 Robertson
5,320,114 A 6/1994 Kittelsen et al.
5,323,787 A 6/1994 Pratt
5,336,086 A 8/1994 Simmen et al.
5,339,832 A 8/1994 Kittelsen et al.
5,353,810 A 10/1994 Kittelsen et al.
5,365,946 A 11/1994 McMillan
5,385,155 A 1/1995 Kittelsen et al.
D356,188 S 3/1995 Kittelsen
5,406,963 A 4/1995 Adell
5,415,544 A 5/1995 Oxman et al.
5,447,168 A 9/1995 Bancroft
5,460,527 A 10/1995 Kittelsen
5,566,683 A 10/1996 Thornton
5,566,684 A 10/1996 Wagner
5,584,687 A 12/1996 Sullivan et al.
5,624,257 A 4/1997 Farrell
5,636,379 A 6/1997 Williams
5,642,737 A 7/1997 Parks
D382,965 S 8/1997 Wagner
5,692,523 A 12/1997 Croll et al.
5,718,575 A 2/1998 Cross, III
5,746,221 A 5/1998 Jones et al.
D397,442 S 8/1998 Kittelsen
5,826,581 A 10/1998 Yoshida
5,836,761 A 11/1998 Belvedere et al.
5,865,619 A 2/1999 Cross, III et al.
5,879,155 A 3/1999 Kittelsen
5,970,981 A 10/1999 Ochel
6,012,919 A 1/2000 Cross, III et al.
6,082,363 A 7/2000 Washburn
6,142,780 A 11/2000 Burgio
6,200,133 B1 3/2001 Kittelsen
6,237,601 B1 5/2001 Kittelsen et al.
D452,011 S 12/2001 Redhage
6,371,758 B1 4/2002 Kittelsen
6,405,729 B1 6/2002 Thornton
6,415,794 B1 7/2002 Kittelsen et al.
6,505,626 B2 1/2003 Kittelsen et al.
6,505,627 B2 1/2003 Kittelsen et al.
6,505,628 B2 1/2003 Kittelsen et al.
6,508,251 B2 1/2003 Kittelsen et al.
6,510,853 B1 1/2003 Kittelsen et al.
6,539,943 B1 4/2003 Kittelsen et al.
6,553,996 B2 4/2003 Kittelsen et al.
6,584,978 B1 7/2003 Brett et al.
6,598,605 B1 7/2003 Kittelsen et al.
6,638,496 B2 10/2003 McLaughlin
6,675,806 B2 1/2004 Kittelsen et al.

(56) References Cited

U.S. PATENT DOCUMENTS

| | | | | |
|---|---|---|---|---|
| D492,785 | S | 7/2004 | Garabito | |
| D504,744 | S | 5/2005 | Hidalgo et al. | |
| 6,978,786 | B2 | 12/2005 | Sabbagh | |
| D527,848 | S | 9/2006 | Manzo et al. | |
| D530,425 | S | 10/2006 | Carlson | |
| D530,863 | S | 10/2006 | Manzo et al. | |
| D532,559 | S | 11/2006 | Manzo et al. | |
| D541,481 | S | 4/2007 | Farrell | |
| D548,402 | S | 8/2007 | Trodick | |
| 7,299,804 | B2 | 11/2007 | Kittelsen et al. | |
| D570,724 | S | 6/2008 | Kittelsen | |
| D586,252 | S | 2/2009 | Kittelsen | |
| D593,714 | S | 6/2009 | Hirshberg | |
| D594,125 | S | 6/2009 | Lesniak | |
| D597,675 | S | 8/2009 | Eli | |
| 7,658,193 | B2 | 2/2010 | Lesniak | |
| D614,304 | S | 4/2010 | Jansheski | |
| D641,478 | S | 7/2011 | Belvedere et al. | |
| 8,033,392 | B1 * | 10/2011 | Gehner et al. | 206/207 |
| 8,116,854 | B2 | 2/2012 | Hart et al. | |
| D663,485 | S | 7/2012 | Turkbas et al. | |
| D663,486 | S | 7/2012 | Turkbas et al. | |
| 2003/0019497 | A1 | 1/2003 | Farrell | |
| 2004/0110111 | A1 | 6/2004 | Wasylucha | |
| 2004/0154626 | A1 | 8/2004 | Washburn et al. | |
| 2004/0250817 | A1 | 12/2004 | Kittelsen et al. | |
| 2011/0114100 | A1 | 5/2011 | Alvarez et al. | |
| 2011/0186055 | A1 | 8/2011 | Makkar et al. | |
| 2012/0111343 | A1 | 5/2012 | Turkbas et al. | |

FOREIGN PATENT DOCUMENTS

| | | |
|---|---|---|
| CA | 886254 | 11/1971 |
| CA | 1147583 | 6/1983 |
| DE | 0480423 | 8/1929 |
| EP | 0426172 | 7/1994 |
| EP | 0651670 | 5/1995 |
| WO | WO 91/03215 | 3/1991 |
| WO | WO 93/08761 | 5/1993 |
| WO | WO 00/35369 | 6/2000 |
| WO | WO 2009/026538 | 2/2009 |

OTHER PUBLICATIONS

International Search Report issued in PCT/US94/05306, mailed Oct. 4, 1994, 3 pages.

* cited by examiner

MOUTHGUARD WITH LINEAR STORAGE CONFIGURATION

RELATED APPLICATION

This application claims the benefit of U.S. Provisional Application No. 61/345,331 filed May 17, 2010 entitled "MOUTH GUARD," which application is incorporated by reference herein in its entirety.

TECHNICAL FIELD

The disclosure pertains generally to mouthguards.

BACKGROUND

In general, mouthguards are used to protect an athlete's teeth while engaged in a sporting activity. Several prior art mouthguards include a V-shaped base member with inner and outer flanges that extend upwardly to surround the wearer's upper and/or lower teeth. Such mouthguards cushion the impact of the upper and/or lower teeth and protect the teeth in response to jarring action or impact.

One typical type of mouthguard is a dental tray which is generally pre-formed to mimic the shaped of a person's mandibular/maxillary arch configurations. Several prior art mouthguards are made from ethylene vinyl acetate (EVA), which is a softenable thermoplastic. EVA's softening point is less than the temperature of boiling water. Therefore, such a mouthguard may be formed, or custom fit, to the wearer's mouth by placing the mouthguard in hot water until it becomes soft, and then placing it in the wearer's mouth. Such a mouthguard retains the shape of the wearer's teeth and mouth upon cooling. These traditional mouthguards can provide excellent protection, but often times are ill-fitting and uncomfortable.

Conventional mouthguards may be fabricated from a variety of thermoplastic materials, and are typically molded into a shape that is similar to one or both of the mandibular or maxillary arches. For the purposes of this application, such conventional mouthguard configuration is referred to as "tray-style" mouthguards. Traditional tray style mouthguards do not possess the ability to comfortably adjust to widely varying tooth shape or mandibular/maxillary arch configurations and can be ill-fitting and uncomfortable. Individuals with wide upper or lower jaws often have difficulty finding mouthguards that fit without modifying the structure of the mouthguard.

A traditional mouthguard for individuals with braces is simply placed in the wearer's mouth. Currently marketed mouthguards for braces or other dental appliances are composed of medical grade silicone, or other high temperature materials that cannot be heated or boiled for fitting around the teeth and gums. Because such traditional mouthguards cannot be fitted, they tend to move around in the mouth, making it difficult to breathe and speak, and they fail to provide adequate protection, depending at least in part upon the position at the time of impact. However, if EVA or a similar low temperature melting plastic were used, for example, the softer plastic could easily become entangled with the braces and cause damage or inconvenience such as shifting or pulling wires. Because every mouth has a different shape, a non-fitted mouthguard is inadequate for a great number of wearers. in addition, impact absorption increases with improved fit.

Traditional tray-style mouthguards also inhibit the wearer's ability to communicate while the device is within the mouth. Thus, many traditional mouthguards are frequently removed to allow the athlete to better communicate and is either carried in the person's hand, pressed into a portion of the helmet, or left dangle from a strap attachment fastening the mouthguard to a sports helmet. The device is then reinserted into the mouth after communications are completed and prior to the next play.

Traditional pre-formed tray-style mouthguards require packaging that is bulky and inefficient for shipping and storage. The generally U-shaped mouthguards are ill suited for tight efficient packing for shipping, storage, or merchandise display. There is a significant need for an improved mouthguard which enables a user to breathe through his/her mouth while wearing the mouthguard.

Therefore, there remains a need for new mouthguard configurations that accommodate a wide variety of mandibular/maxillary arch and tooth configurations, reduce the necessity to remove the mouthguard in an effort to communicate, allow the wearer to breathe more naturally through their mouth while the mouthguard is gripped between their teeth, and are suited for efficient shipping, storage, and merchandise display.

SUMMARY

In some embodiments, the present invention pertains to a mouthguard having a generally linear, initial configuration that addresses issues found in prior art mouthguard configurations.

In some embodiments, the invention is directed to a mouthguard that includes a first trough region that is generally shaped to receive enclose one or more teeth on a first side of a mouth and a second trough region that is generally shaped to receive one or more teeth on a second side of the mouth. A connection element fixedly attaches the first trough region to the second trough region. The mouthguard is biased into a generally linear or straight initial configuration.

In some embodiments, the invention is directed to a mouthguard system that includes an elongate hollow mouthguard storage container as well as a mouthguard that is disposable within the elongate hollow mouthguard storage container. The mouthguard has a generally straight storage configuration.

In some embodiments, the invention is directed to a method of using a mouthguard that has a first trough region, a second trough region, a connection element spanning therebetween, and a generally straight initial configuration. The mouthguard may be removed from an elongate hollow mouthguard storage container and may be bent into a curved configuration. The mouthguard may then be placed in the wearer's mouth such the first trough region receives one or more teeth on a first side of the mouth and the second trough region receives one or more teeth on a second side of the mouth.

In some embodiments, the inventive mouthguard and mouthguard packaging provide advantages and benefits not found in the prior art. In some embodiments, the connection region provides a passageway for air to travel while the mouthguard is gripped between the wearer's teeth and thus the wearer is able to easily breathe while wearing the mouthguard. In some embodiments, the inventive mouthguard is configured to accommodate a person wearing braces or other dental appliances while providing both comfort and protection. In some embodiments, portions of the mouthguard that come into contact with biting areas of a wearer's teeth are softenable and formable while other portions of the mouthguard, including an inner surface that comes into contact with outer surfaces of a wearer's teeth or the wearer's braces, is less softenable and formable.

Further novel features and other objects of the present invention will become apparent from the following detailed description, discussion and the appended claims, taken in conjunction with the drawings.

DETAILED DESCRIPTION

Figure 1:
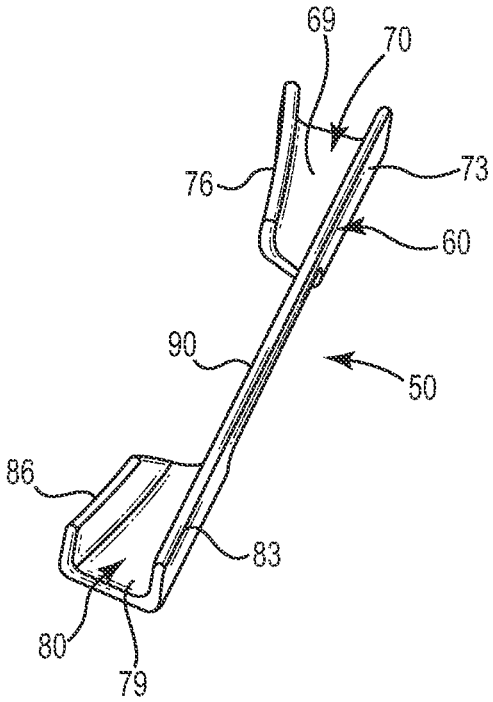
FIG. 1 is an end perspective view of an embodiment of the mouthguard.

At the outset, it should be understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "interior" and "exterior" generally refer to the orientation of a surface relative to its axis of elongation, or axis of rotation, as appropriate.

Although specific embodiments of the present invention will now be described with reference to the drawings, it should be understood that such embodiments are by way of example only and merely illustrative of the many possible specific embodiments which can represent applications of the principles of the present invention. Various changes and modifications obvious to one skilled in the art, after presentation of the inventive concepts disclosed herein, are deemed to be within the spirit, scope and contemplation of the present invention as further defined in the appended claims.

Referring to FIGS. 1 through 9 there are illustrated embodiments of the inventive mouthguard and combination mouthguard and storage container. In some embodiments, the present invention pertains to a mouthguard 50 with an initial linear or relaxed configuration. This initial linear (relaxed) configuration is a unique feature of the present invention as opposed to the pre-formed U-shaped prior art embodiments discussed above. In some embodiments, such an initial substantially linear configuration is resultant of a thermoplastic molding process, in which mouthguard 50 is molded from a resin into an initial, substantially linear configuration.

The mouthguard 50 includes a mouthguard body 60, having an initial linear configuration, a first end trough region 69 and a second end trough region 79 that is spaced apart from the first end trough region 69 and fixedly attached thereto by a central connection element 90. In some embodiments, as illustrated for example in FIG. 5, the first and second trough regions, 69 and 79, gradually flare as the trough progresses from the central connection element 90 toward the distal ends of the trough regions.

In some embodiments, the initial substantially linear configuration represents a relaxed, unstressed condition for mouthguard 50. The central connection element 90, in cross-section, may be formed in a variety of shapes, such as circular, oval, square, rectangular, or any combination or modification thereof. In some embodiments, the central connection element 90 may include, in cross-section, rounded edges, reduced thicknesses and/or curved surfaces to avoid shapes or surfaces that may irritate the interior tissues of the mouth. In some embodiments, the cross-section may also be configured with a variety of longitudinal widths to increase or decrease the flexibility of the central connection element 90.

In use, the mouthguard 50 may be placed into a user's mouth so that at least some of the user's teeth rest within the first and second trough regions, 69 and 79 respectively, as defined by the teeth receiving trays, 70 and 80, exterior sidewalls, 73 and 83, and interior sidewalls, 76 and 86. Teeth receiving trays 70, 80 may be configured for cooperation with any desired number of teeth, and may be spaced apart by the central connection element 90 to a desired extent to engage with any set of teeth appropriate for a given application. In some embodiments, the first and/or second trays 70, 80 may include upper and lower troughs or regions that are simultaneously cooperative with both maxillary and mandibular teeth, and may be fabricated from one or more materials providing a desired degree of flexibility.

In some embodiments, the configuration of the first end trough region 69 in combination with the generally narrower central connection element 90 fixedly spacing the second end trough region 79, provides a passageway for air to travel through while the mouthguard is gripped between the wearer's teeth. By reducing the profile height on the central connection element 90 as compared to conventional tray style mouthguards, the wearer is able to breathe through the wearer's mouth while gripping the mouthguard between the wearer's teeth. In addition, the relatively narrow central connection element 90 allows speech to a much greater extent than conventional mouthguard designs.

The mouthguard 50 may be formed from a variety of well known thermoplastic or other materials, and may include one or more materials in a single mouthguard. The natural tendency of a resilient molded thermoplastic material enables the structural body to recover its "relaxed" configuration following deformation. In this case, the mouthguard may optionally be sufficiently resilient to recover to a generally linear relaxed configuration upon removal from the mouth (the operating configuration being a "stressed" condition). In this way, the linear configuration is not only the "initial" but also the "unstressed" configuration. In other embodiments, the "relaxed" configuration may be non-linear, with a central connection element 90 that is sufficiently flexible/resilient to by non-destructively manipulated into a substantially linear configuration.

In use, the mouthguard 50 is manipulated from its unstressed, substantially linear configuration, and placed into a user's mouth so that at least some of the user's teeth rest within the first and second trough regions, 69 and 79 respectively, as defined by the teeth receiving trays, 70 and 80, exterior sidewalls, 73 and 83, and interior sidewalls, 76 and 86.

Figure 2A:
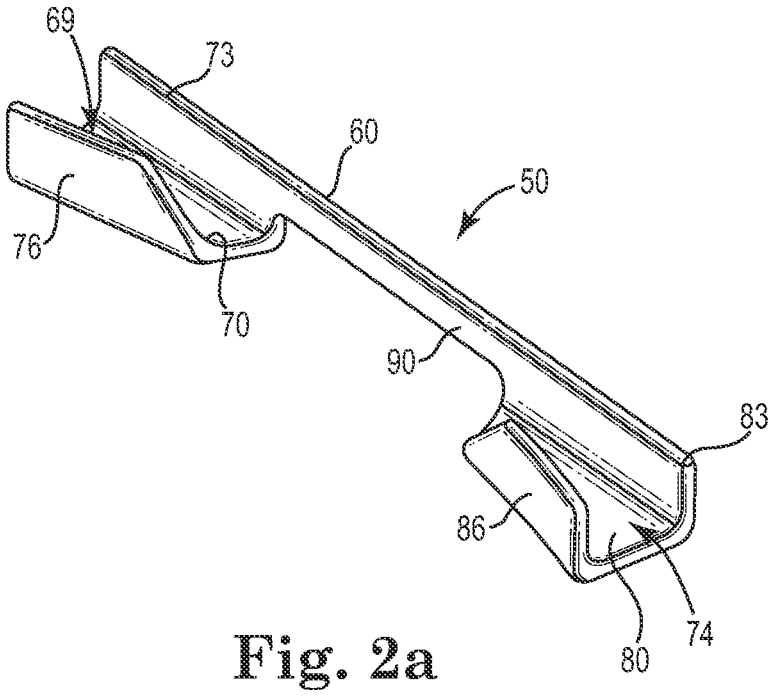
FIG. 2*a* is a rear perspective view of an embodiment of the mouthguard.
Figure 2B:
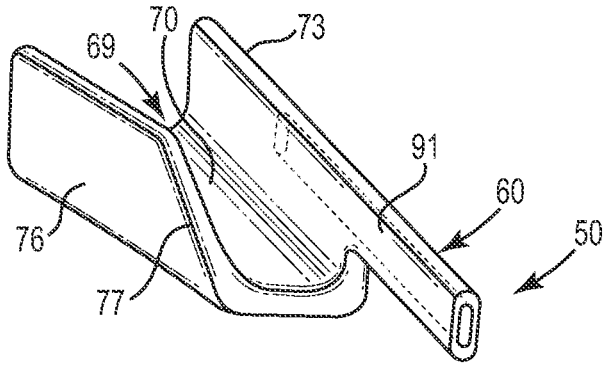
FIG. 2*b* is a cross-sectional, rear perspective view of an embodiment of the mouthguard.

In some embodiments as illustrated in FIG. 2*b*, the central connection element 90 may be configured to be moved from a generally straight configuration to a curved configuration and retain at least part of its curved configuration. The central connection element 90 may include a retaining reinforcement element 91 that allows the user to create a generally U-shaped second configuration that mimics the shape of a person's mandibular/maxillary arch configuration. This retaining material may include wire or other suitable materials to maintain a second, stressed configuration of mouthguard 50.

Figure 3:
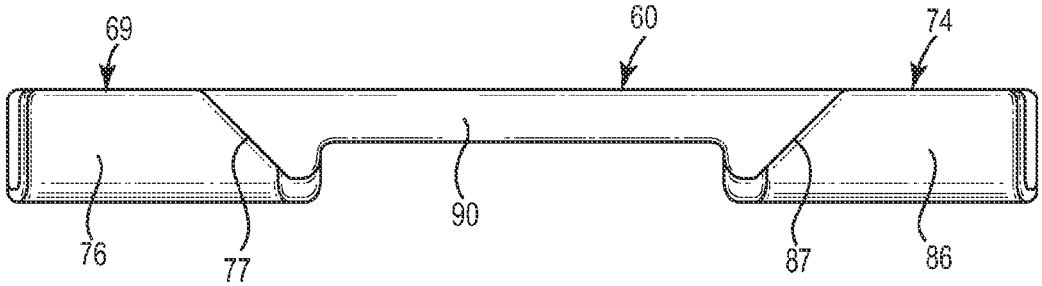
FIG. 3 is a rear view of an embodiment of the mouthguard.

In some embodiments, as illustrated in FIG. 3, the mouthguard body 60 may be configured to improve the wearer's comfort. FIG. 3 is a rear view of the mouthguard's 50 initial linear/relaxed configuration, showing that the first and second interior sidewalls, 76 and 86, each possess a cutaway section, 77 and 87 respectively. These cutaway sections, 77 and 87, provide for a comfortable transition of the interior sidewalls, 76 and 86, into the teeth receiving trays, 70 and 80, without irritation to the wearer's tongue. In use, the cutaways, 77 and 87, also aid in creating the passageway for air to travel through while the mouthguard is gripped between the wearer's teeth by reducing the quantity of the mouthguard material within the mouth cavity.

Figure 4:
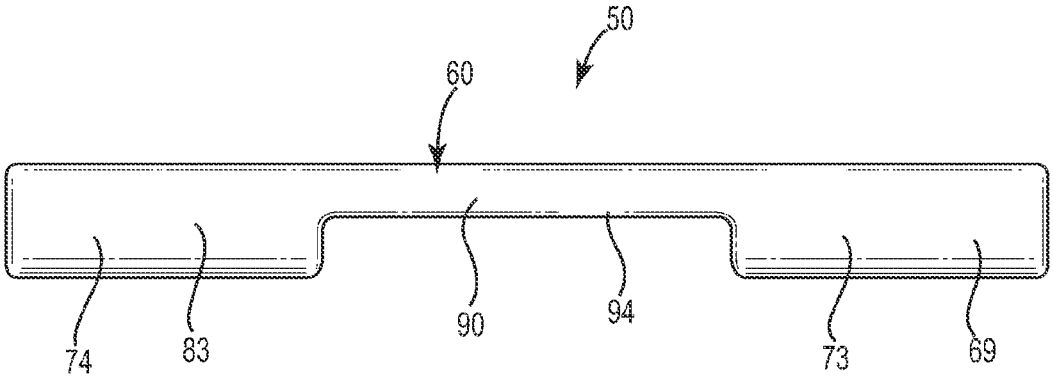
FIG. 4 is a front view of an embodiment of the mouthguard.
Figure 5:
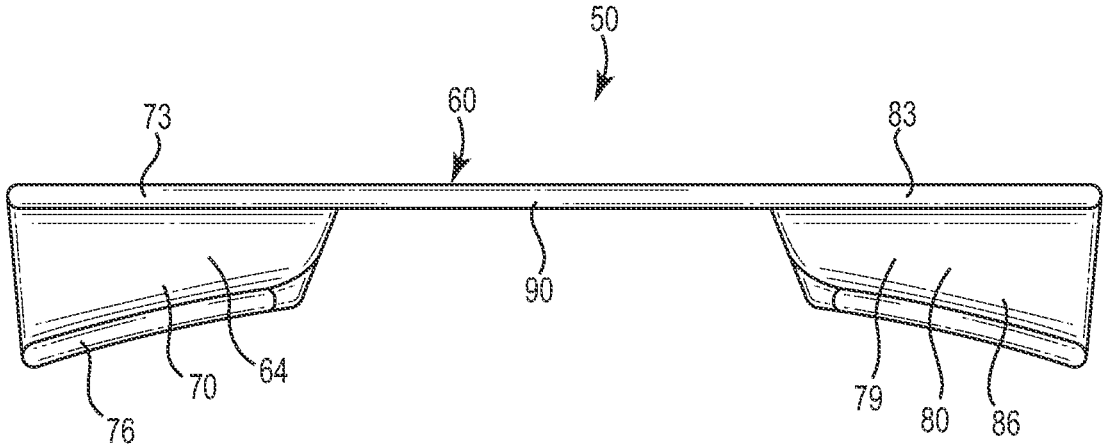
FIG. 5 is a top view of an embodiment of the mouthguard.
Figure 6:
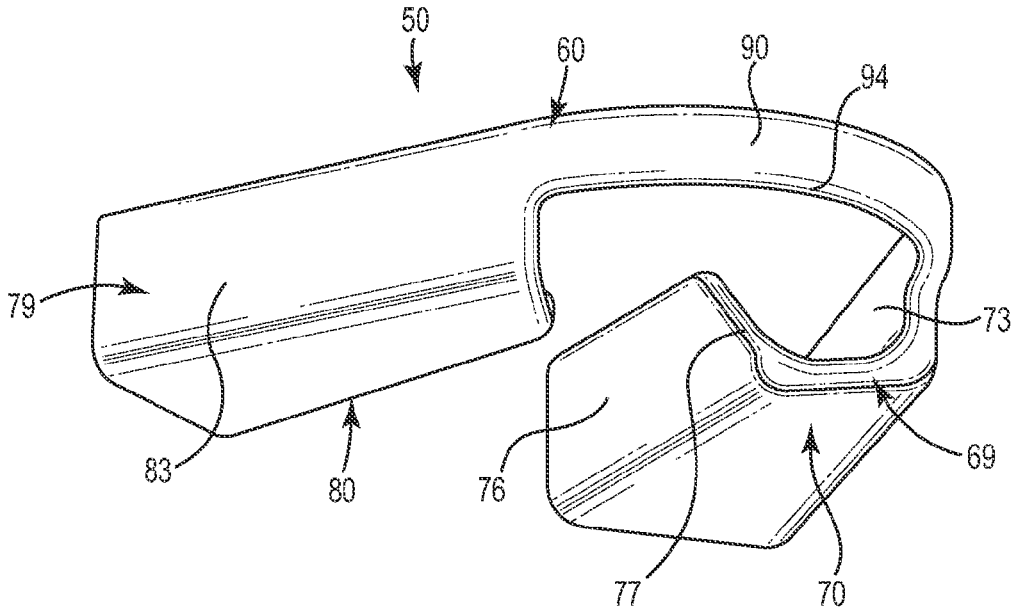
FIG. 6 is a bottom perspective view of an embodiment of the mouthguard in a non-linear configuration.
Figure 7:
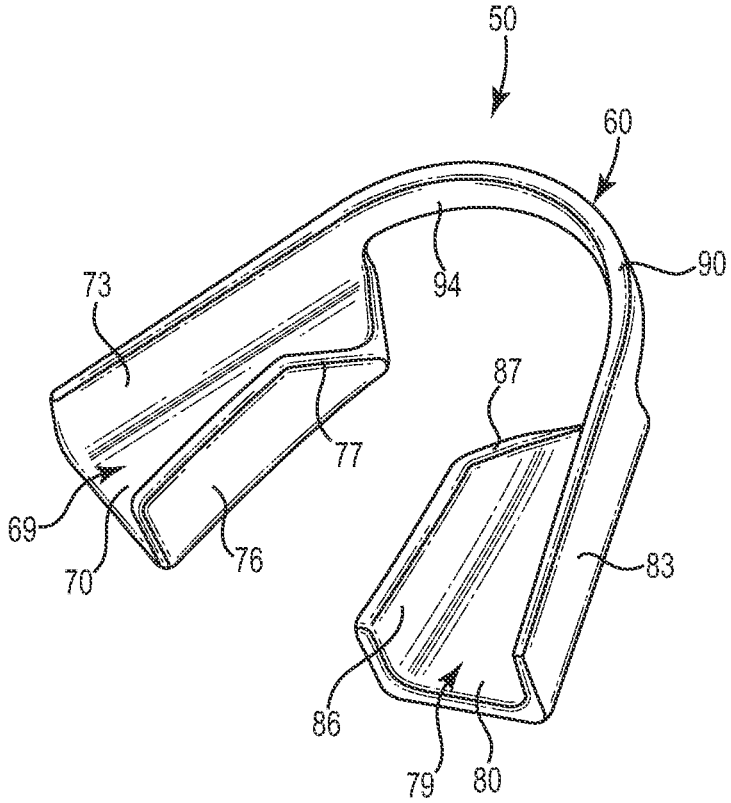
FIG. 7 is a top perspective view of an embodiment of the mouthguard in a non-linear configuration.
Figure 8:
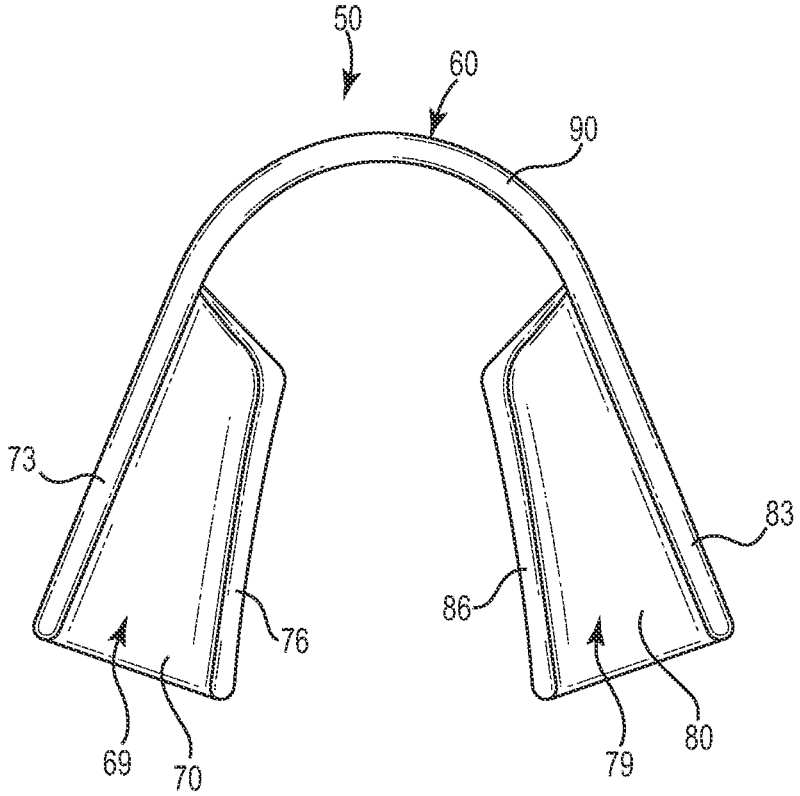
FIG. 8 is a top view of an embodiment of the mouthguard in a non-linear configuration.

In some embodiments, as illustrated in FIG. 4, a lower edge 94 of the generally narrow shape of the central connection element 90 defines a general void that creates the passageway for air to travel through while the mouthguard is gripped between the wearer's teeth. In some embodiments, the latitudinal length of the central connection region 90, between the first end trough region 69 and the second end trough region 79, may be adjusted to create a mouthguard so sized to accommodate a variety of mouth shapes and sizes for persons of all ages from children to adults. Traditional tray style mouthguards do not possess the ability to comfortably adjust to widely varying tooth shape or placement configurations. In some cases, individuals with wide upper or lower jaws often find it difficult to find mouthguards that fit.

The latitudinal length of the central connection region 90 may also be selected to provide protection for specific teeth within the mouth or to remove pressure from selected teeth within the mouth. For example, longer central connection regions 90 will move the first and second trough regions, 69 and 79 back into the mouth, while shorter central connection regions 90 will move the first and second trough regions, 69 and 79 toward the front of the mouth. Thus, it may be possible to reduce or eliminate pressure on selected teeth.

Figure 9:
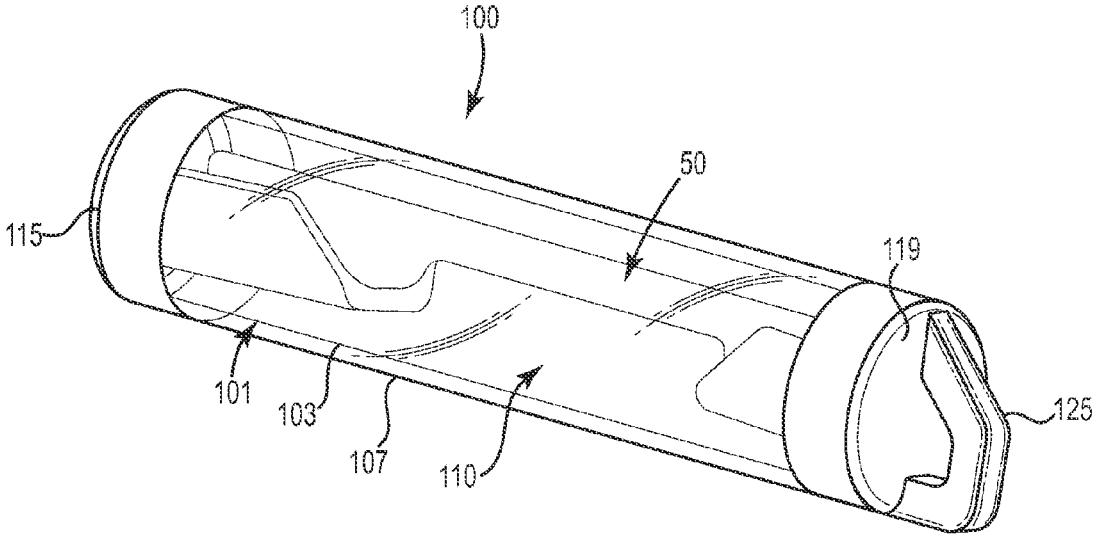
FIG. 9 is a perspective view of an embodiment of the mouthguard within a generally tubular storage container.
Figure 10:
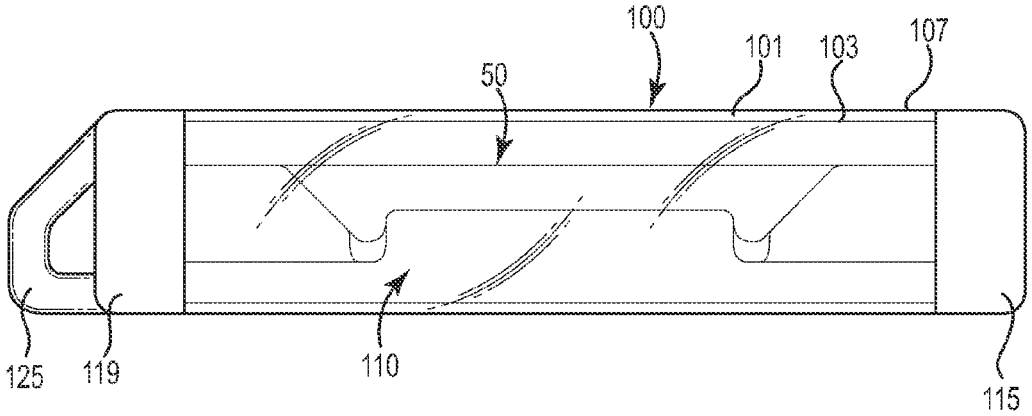
FIG. 10 is a side view of an embodiment of the mouthguard within an elongate hollow storage container.

FIG. 9 is a rear perspective view of the mouthguard 50 depicted within a generally hollow, tubular storage container 100, defined by a container wall 101 that defines an internal enclosure volume 110. In the illustrated embodiment, storage container 100 substantially reduces the volume required to store a mouthguard in comparison to storage containers of conventional tray-style mouthguards. As a result, it will be appreciated that a mouthguard display assembly may permit display of a greater number of mouthguards in a given space. Such a reduction is facilitated, for example, by the substantially linear unstressed configuration of mouthguard 50, so as to be enclosable within a substantially linear tubular container. FIG. 10 is a rear view of the mouthguard 50 depicted within a generally hollow, cylindrical storage container 100, defined by a container wall 101, comprising: a container sidewall 103. The container wall 101 defines an internal enclosure volume 110.

Figure 11:
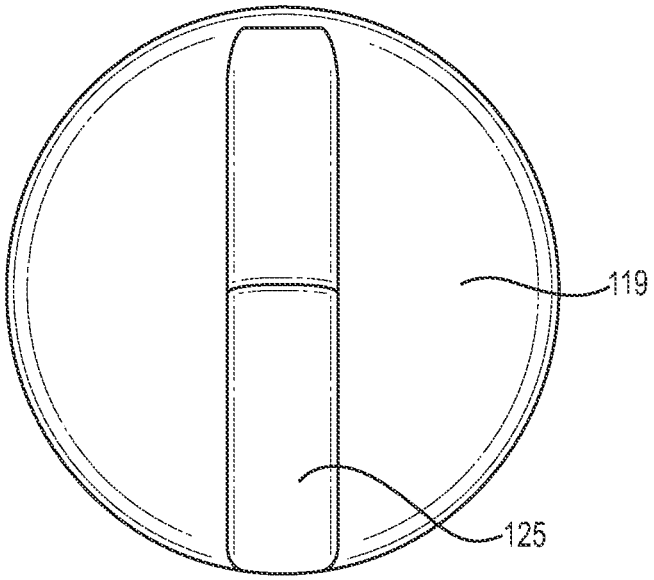
FIG. 11 is an end view of the elongate hollow storage container.

In some embodiments, the generally hollow, tubular storage container 100 includes an end cap 115 and a reversibly attached closure end cap 119. FIG. 11 is a front view of the reversibly attached closure end cap 119, with closure grip tab 125. The reversibly attached closure end cap 119 may be of a variety of well know reversibly locking caps such as a threaded cap or a snap fit locking cap. The reversibly attached closure end cap 119, of the current embodiment, depicts a closure grip tab 125. The closure grip tab 125 provides two functions. First, it acts as a means for gripping the closure cap. Second, it acts as a hanging tab for the container used in conjunction with a sales display in a commercial setting.

The unique initial linear/relaxed configuration allows for the use of the generally hollow, tubular storage container 100. The substantially linear storage container of the present invention overcomes the traditional requirement for bulky packaging to accommodate the typical U-shape of the tray-type mouthguards. The tubular storage container is efficient for shipping and storage needs because it allows for tight, compact and orderly packing, substantially more so than containers for conventional mouthguards.

What is claimed is:

1. A mouthguard comprising:

a first trough region, generally shaped to receive one or more teeth on a first side of a mouth, the first trough region including a first exterior sidewall;

a second trough region, generally shaped to receive one or more teeth on a second side of the mouth, the second trough region including a second exterior sidewall; and a connection element that extends between the first trough region and the second trough region;

wherein the mouthguard is biased into a generally straight initial configuration in which the first exterior wall, the second exterior wall and the connection element are generally aligned in a straight line;

wherein the first trough region and the second trough region are configured to enclose at least some of a wearer's upper first side teeth and upper second side teeth, respectively.

2. The mouthguard of claim 1, wherein the connection element is configured to span the wearer's upper front teeth when at least some of the wearer's upper teeth are enclosed.

3. The mouthguard of claim 1, wherein the connection element has a length that is determined in order to position the first trough region and the second trough region at a desired location within the wearer's mouth.

4. A mouthguard comprising:

a first trough region, generally shaped to receive one or more teeth on a first side of a mouth;

a second trough region, generally shaped to receive one or more teeth on a second side of the mouth; and a connection element that extends between the first trough region and the second trough region;

wherein the mouthguard is biased into an initial configuration in which the first and second trough regions are spaced apart with the connection element and the first and second trough regions in a plane, the mouthguard having a use configuration in which the first trough region and the second trough region are able to move closer together in the plane such that the first trough region can receive one or more teeth on the first side of the mouth and the second trough region can receive one or more teeth on the second side of the mouth;

wherein the first trough region and the second trough region are configured to enclose at least some of a wearer's upper first side teeth and upper second side teeth, respectively.

* * * * *